United States Patent [19]

Hugo et al.

[11] Patent Number: 4,892,119

[45] Date of Patent: Jan. 9, 1990

[54] CHANGING CLOTH BEAMS IN A WEAVING MILL

[75] Inventors: Schilling Hugo, Winterthur, Switzerland; Günter Veith, Münsingen-Dottingen, Fed. Rep. of Germany; Zünd Marcel, Winterthur, Switzerland

[73] Assignee: Sulzer Brothers Limited, Winterthur, Switzerland.

[21] Appl. No.: 206,185

[22] Filed: Jun. 13, 1988

[30] Foreign Application Priority Data

Jun. 16, 1987 [CH] Switzerland ..... 02268/87

[51] Int. Cl.[4] ..... D03D 49/00

[52] U.S. Cl. ..... 129/1 R; 139/291 C; 139/304; 242/58.3; 242/66; 414/458

[58] Field of Search ..... 139/1 R, 304, 291 R, 139/291 C; 242/66, 58.1, 58.2, 58.3, 58.4; 28/201, 208; 414/458, 911

[56] References Cited

U.S. PATENT DOCUMENTS 3,106,360 10/1963 Kohler ..... 242/58.3
4,345,722 8/1982 Kuhn ..... 242/66
4,606,381 8/1986 Suwa et al. ..... 139/1 R
4,612,080 9/1986 Aiuola et al. ..... 242/58.3 X

FOREIGN PATENT DOCUMENTS 2417476 10/1975 Fed. Rep. of Germany .
3033837 6/1982 Fed. Rep. of Germany .
60-171956 2/1984 Japan .

OTHER PUBLICATIONS

Genkinger Machine Brochure, Batson Group Inc., Greenville, S.C., 5/1985.

*Primary Examiner*—Andrew M. Falik
*Attorney, Agent, or Firm*—Kenyon & Kenyon

[57] ABSTRACT

A transporter is constructed to exchange an empty cloth beam for a full cloth beam of a weaving machine; the cloth being wound into the empty beam while the empty beams remains in the transporter. The transporter has a pair of gripper arm which are automatically acutated in order to transfer a full cloth beam from the weaving machine into the transporter. The gripper arms thereafter move a wind-on beam within the transporter into a position to effect a transfer of the cloth to a fresh cloth beam in the transporter. The gripper arms then move the fresh cloth beam into the weaving machine.

14 Claims, 13 Drawing Sheets

CHANGING CLOTH BEAMS IN A WEAVING MILL

This invention relates to a method and apparatus for changing beams in a weaving mill. More particularly, this invention relates to a transporter for changing cloth beams in weaving machines.

Heretofore, transporters have been used for the changing of cloth beams in weaving machines within a weaving mill. For example, Japanese Patent Publication No. 60171956 describes a transportation truck with arms for receiving a cloth beam out of a weaving machine. After a full cloth beam has been positioned in the truck, a new cloth beam is inserted from the truck into the weaving machine. In these cases, the winding of the fabric onto the new cloth beam occurs within the weaving machine by means of an auxiliary device. However, in practice, only the cloth beam side facing the weaver's gangway is accessible for winding the cloth onto the new cloth beam. Since the space conditions in the area of the cloth beam in the bottom part of a weaving machine are normally very restricted, the transportation truck must be very accurately adjusted to the weaving machine.

Accordingly, it is an object of the invention to provide a cloth beam transporter which can be used independently of any specific type of weaving machine.

It is another object of the invention to provide a relatively simple technique for exchanging a fresh cloth beam for a full cloth beam in a weaving machine.

It is another object of the invention to provide for the winding on of a fabric onto a fresh cloth beam prior to insertion of the cloth beam into a weaving machine.

Briefly, the invention provides a method of changing cloth beams in a weaving mill as well as a transporter for the exchange of cloth beams in the weaving machines of a weaving mill.

In accordance with the method, a full cloth beam is first transferred from a weaving machine into a predetermined position in the transporter after the transporter has been moved into position astride the weaving machine. Thereafter, a wind-on beam in the transporter is moved into the path of the fabric extending between the weaving machine and the full cloth beam in order to form a loop of fabric. The wind-on beam is then moved with the loop of fabric about a fresh cloth beam mounted in the transporter.

With the wind-on beam positioned about the fresh cloth beam so as to lay the fabric onto the cloth beam, the fabric is cut between the fresh cloth beam and the full cloth beam. The resultant free cut end of the fabric is then positioned against the fresh cloth beam, for example, by means of a blade. The fresh cloth beam is then rotated to wind the fabric thereon over the free cut end of the fabric. During this time, the free end of the fabric is pressed firmly against the fresh cloth beam by the overlying windings of fabric. Thereafter, the fresh cloth beam with the fabric windings thereon is transferred to the weaving machine.

The transporter includes a device for receiving a full cloth beam, means for mounting at least one drivable fresh cloth beam, a wind-on beam and gripper arms for moving the wind-on beam between a received full cloth beam and a mounted fresh cloth beam. During operation, the gripper arms are movable from a first position to engage the wind-on beam to a second position for positioning the wind-on beam between the mounted full cloth beam and the mounted fresh cloth beam in order to form a loop in the fabric. The arms are also movable from a third position engaging the fresh cloth beam after the winding of fabric has been made thereon to a fourth position to position the fresh cloth beam in the weaving machine.

In order to facilitate gripping of the fresh cloth beam by the gripper arms, an adaptor disc is mounted at each end of the cloth beam and is shaped relative to a gripper arm so as to be engagable therewith. Each of these discs may also have a plurality of bores for engaging with a dog clutch which serves as part of a means for mounting the fresh cloth beam in the transporter. Each dog clutch thus serves for the driving and carrying of the fresh cloth beam.

In accordance with the method, the full cloth beam can be removed from the weaving machine and initially stored in the transporter by means of the gripper arms without cutting of the fabric. Further, the weaving machine may continue to operate so that cloth is continuously produced without interruption.

The transporter can be used immediately for different types of weaving machines provided there is sufficient free space for the transporter gripper arms at the cloth beam bearings in a weaving machine. Since the fresh cloth beam is wound on in the transporter, the beam is accessible, in practice from each side of the transporter so that the winding-on operation may progress reliably without any slippage of the wound-on fabric. The automatic operation of the transporter requires the cloth beam bearings of a weaving machine to be of a type which can be opened automatically.

These and other objects and advantages of the invention will become more apparent from the following detailed description taken in conjunction with the accompanying drawings wherein:

FIG. 1 illustrates a side view of a transporter according to the invention positioned astride a weaving machine in a weaving mill;

FIG. 1*a* schematically illustrates a perspective view of the transporter constructed in accordance with the invention;

Figure 13A:
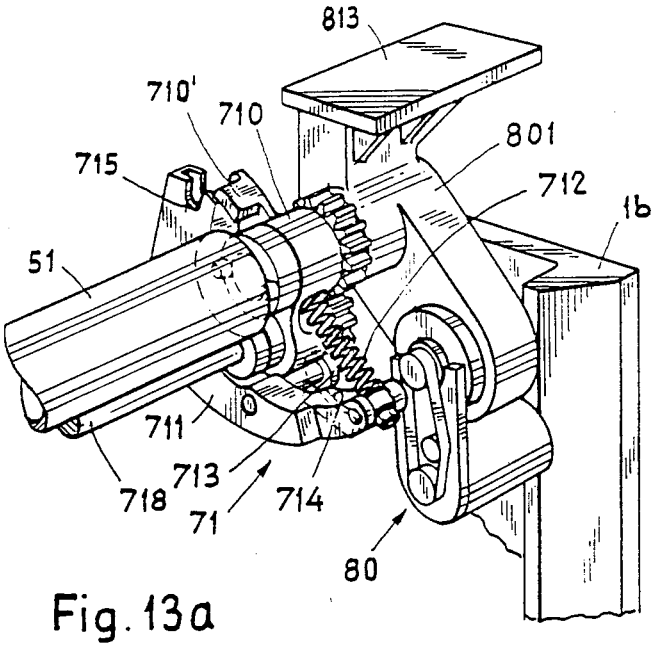
Figure 13B:
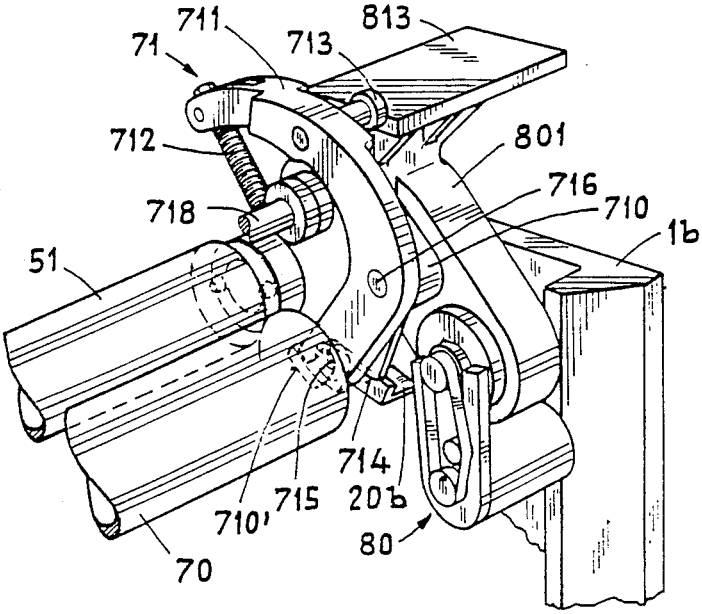

FIG. 13*a* illustrates an enlarged view of a manipulator for movement of the wind-on beam about the empty cloth beam: and FIG. 13*b* illustrates a view similar to FIG. 13*a* with the wind-on beam moved about the empty cloth beam.

Figure 1:
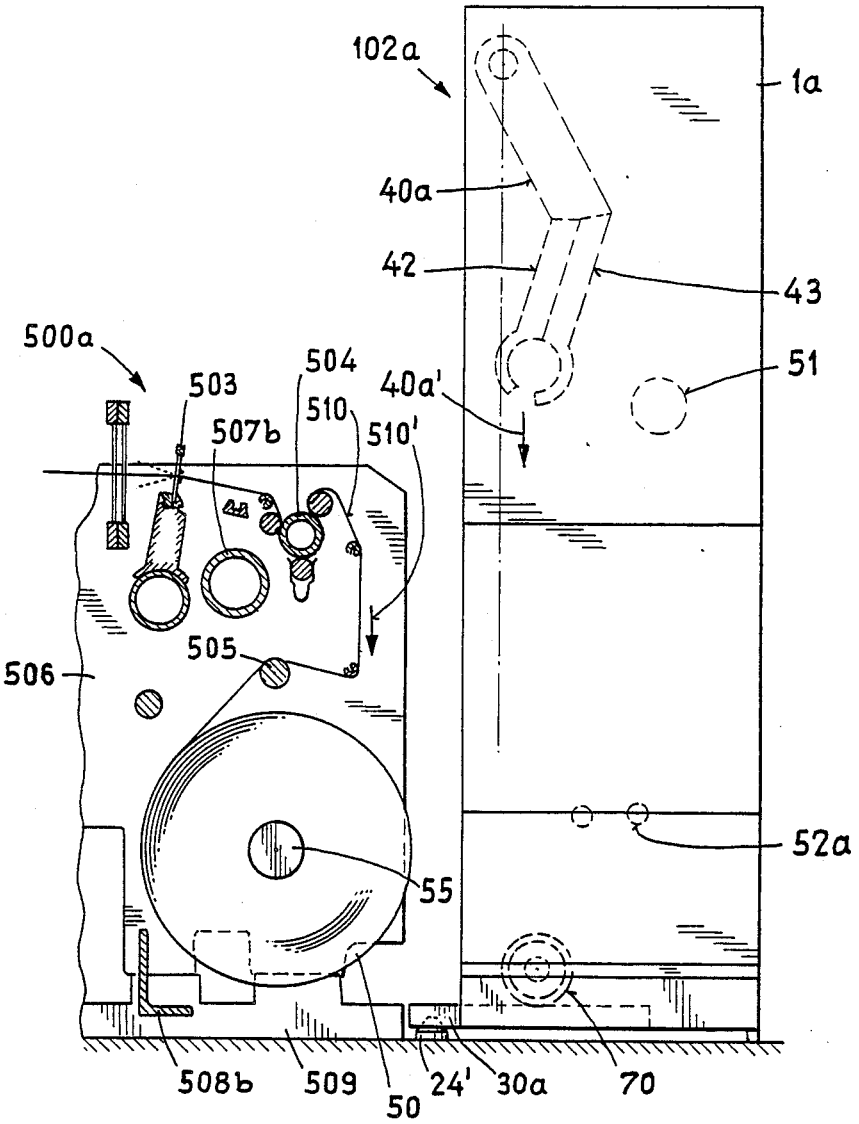
Figure 1A:
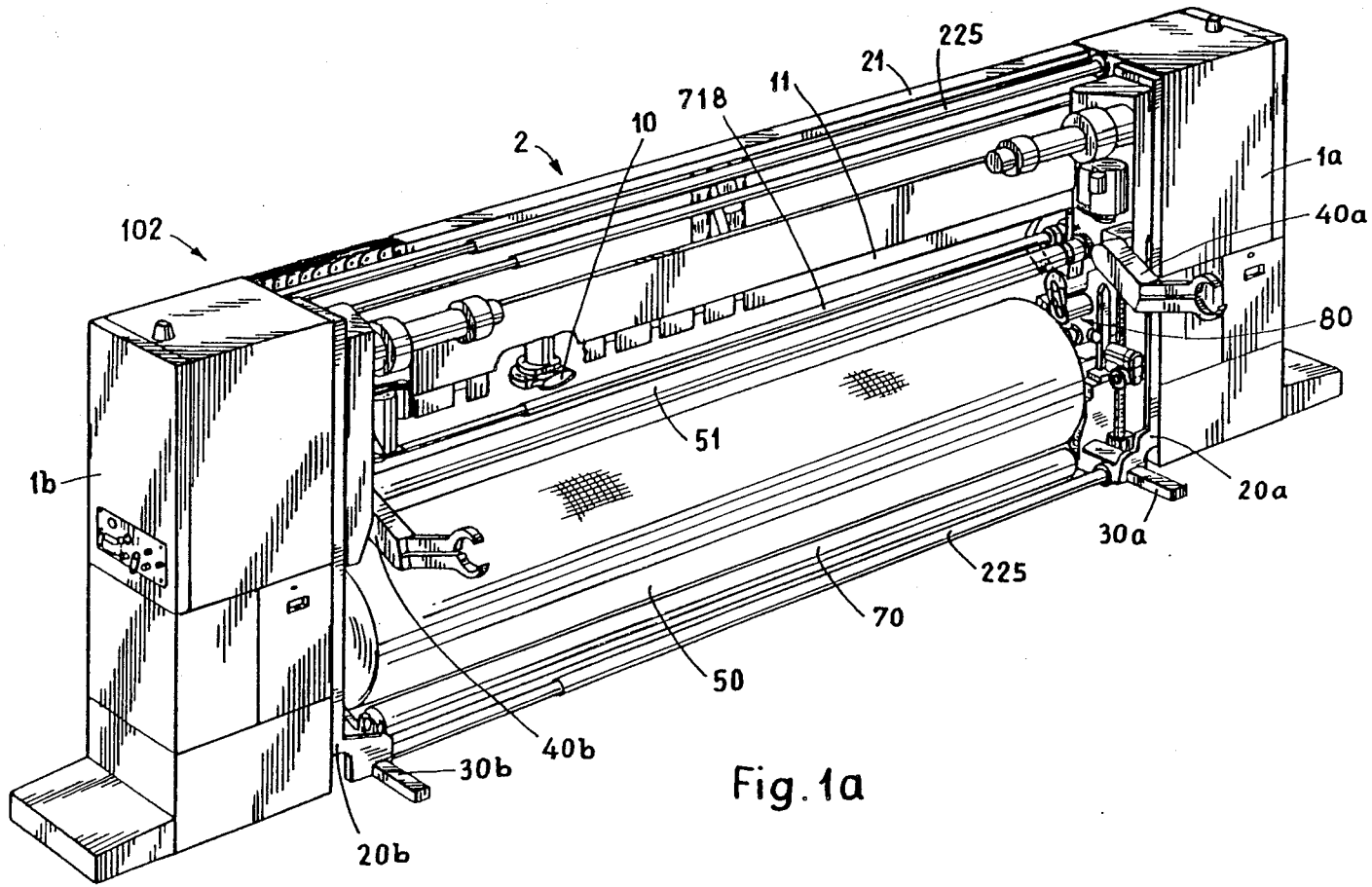

Referring to FIG. 1*a*, the transporter 102 is constructed of a pair of mobile units 1*a*, 1*b* with a carrier unit 2 disposed therebetween.

Each mobile unit 1*b* is provided with a propulsion unit (not shown) for driving of the transporter 102 along the floor of a mill. In addition, each mobile unit 1*a*, 1*b* is provided with rollers (not shown) for rolling of the transporter 102 along the floor of the mill. The carrier unit 2 is mounted on the mobile units 1*b* so as to be moved vertically as well as slightly horizontally after the transporter has come to a position astride a weaving machine. As illustrated, the carrier unit 2 has been provided with a means for mounting for a full cloth beam 50, a means for mounting an empty cloth beam 51 and a wind-on beam 70. In addition, means are provided in the form of a pair of gripper arms 40*a*, 40*b* for manipulating the respective beams as described below.

The carrier unit 2 also has a cutter 10 which is movable longitudinal of the transporter 102 for the cutting of the cloth and a folder blade 11 for purposes as described below.

The carrier unit is formed of a pair of side parts 20*a*, 20*b* which are interconnected by a cross member 21 which is displaceable with respect to the left-hand side part 20*b*. In addition, a plurality of telescopic rods 225 are positioned between the side parts 20*a*, 20*b* by means of which the length of the transporter 102 can be adapted to the particular type of weaving machine which requires servicing.

The carrier unit 2 also has extendable supports 30*a*, 30*b* to provide lateral stability to the carrier unit 2 when mounted on the floor of the weaving mill.

Referring to FIG. 1, the means for mounting a cloth beam in the transporter 102 includes a pair of mounting rollers 52*a* located above the plane of the winding-on beam and below the mounted empty cloth beam. As also indicated, each gripper arm 40*a* has a pair of limbs 42, 43 which can be pivoted relative to each other for the gripping of a respective beam.

As indicated, the weaving machine 500*a* is constructed so that a plurality of warp yarns can be passed to a sley 503 where a weft is picked in order to form a fabric 510. The fabric 510 is then fed via a fabric take-off motion 504 and guide rods 505 to a cloth beam 50 and wound thereon.

The various components of the weaving machine are mounted between side plates 506 which are connected by tubular cross members 507*b* and angle cross members 508*b*. As indicated, the side plates 506 are supported on foot rails 509.

During operation of the weaving machine, the fabric is wound on the cloth beam 50 until reaching a maximum permissible diameter. This can be indicated by a sensor (not shown) within the weaving machine 500*a*. A logistic control device (not shown) in the weaving mill then orders the transporter 102 in to a position astride the weaving machine.

Once the transporter 102 has been positioned, a cloth beam changing operation is carried out as follows.

Figure 2:
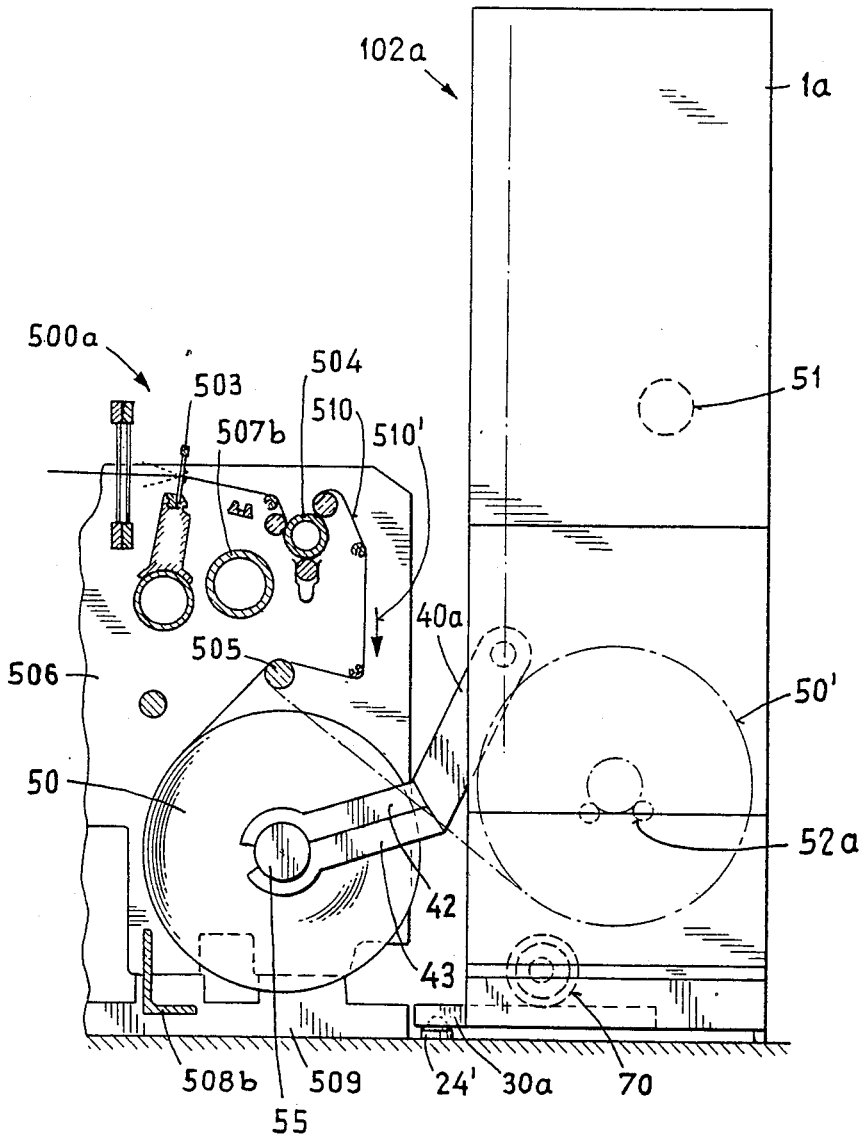
FIG. 2 illustrates the gripper arms of the transporter in a position for removing a full cloth beam from a weaving machine.

Initially, the gripper arms 40*a*, 40*b* are moved vertically downwardly on a vertical axis in the direction indicated by the arrow 40*a*'. In so doing, the arms also pivot to the left, as viewed, about a pivot at the top end and engage about journals 55 of the cloth beam 50 while the limbs 42, 43 move into an open position. After engaging with the journals 55 (see FIG. 2) the gripper arms are moved upwardly while also pivoting to the right in order to lift the cloth beam 50 out of the weaving machine for depositing onto the rollers 52*a* of the transporter 102. The mounted position of the cloth beam 50' is indicated in dotted line.

Figure 3:
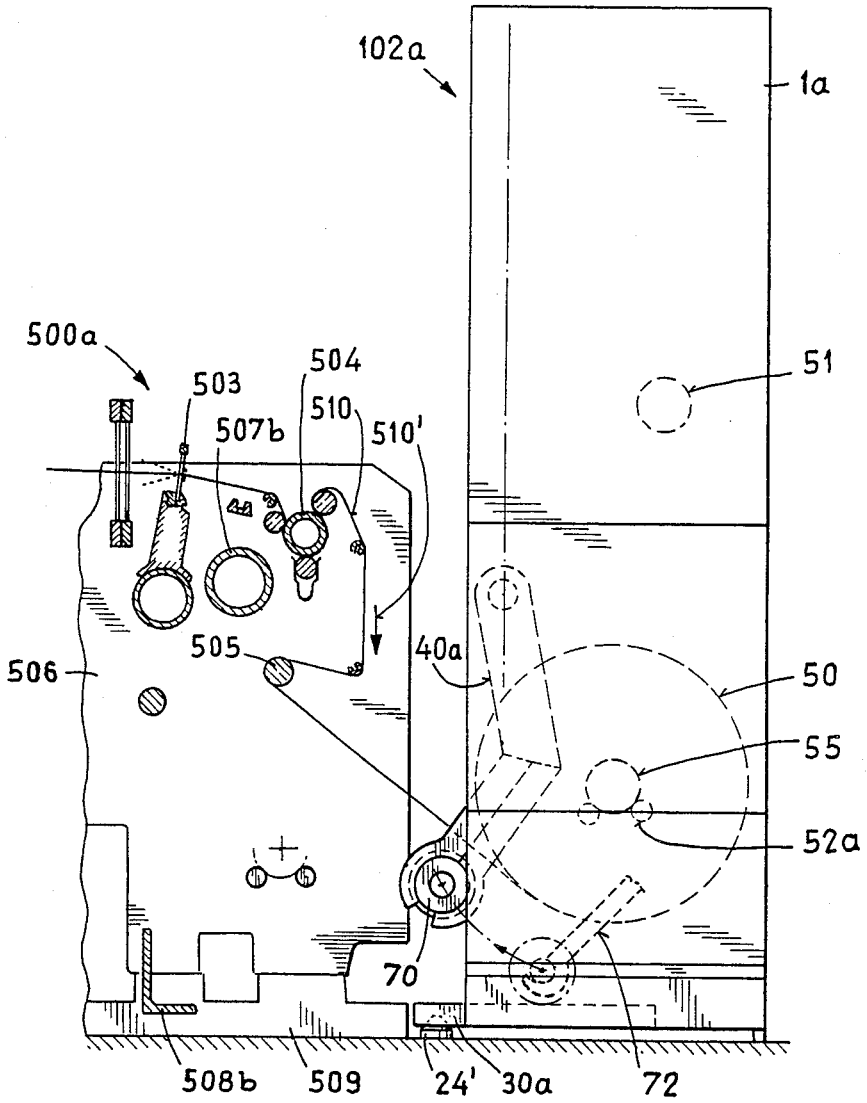
FIG. 3 illustrates a view similar to FIG. 2 of the gripper arms in a position moving the wind-on beam within the transporter.
Figure 4:
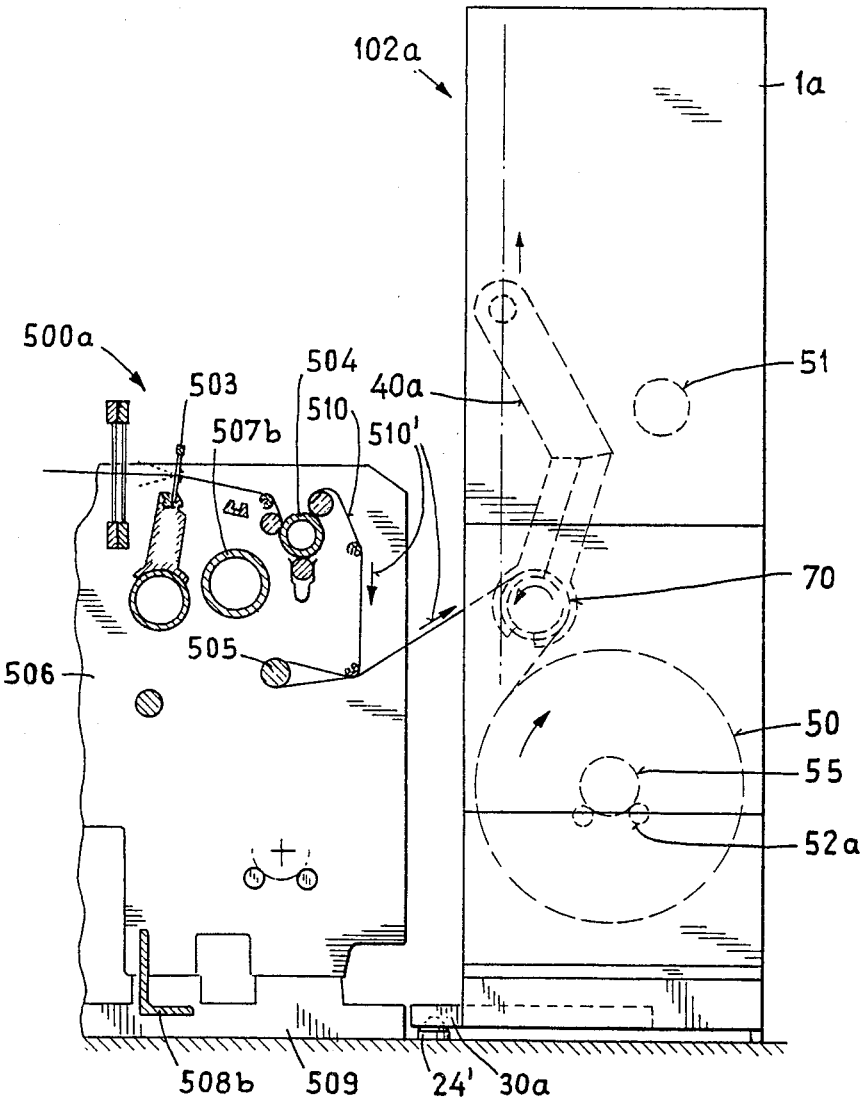
FIG. 4 illustrates a view similar to FIG. 2 of the gripper arms and wind-on beam in a position forming a loop in the fabric.

Referring to FIG. 3, the transporter is provided with a manipulator 72 which serves to lift the wind-on beam 70 from a position of rest into a position to be taken over by the gripper arms 40*a*, 40*b*. From this position, the gripper arms move the wind-on beam into the path of the fabric extending from the guide roller 505 of the weaving machine to the full cloth beam 50. Continued movement of the gripper arms into the position indicated in FIG. 4 causes a loop of fabric to be formed. During this time, the fabric has to be unwound from the cloth beam 50 which thus rotates in the direction indicated by the arrow. At the same time, the wind-on beam 70 also rotates counter-clockwise as indicated by the arrow under the influence of the fabric. During the cloth beam change, there is no need to stop the weaving machine so that new fabric is continuously carrier away from the weaving machine in the direction of the arrow 510'.

Figure 5:
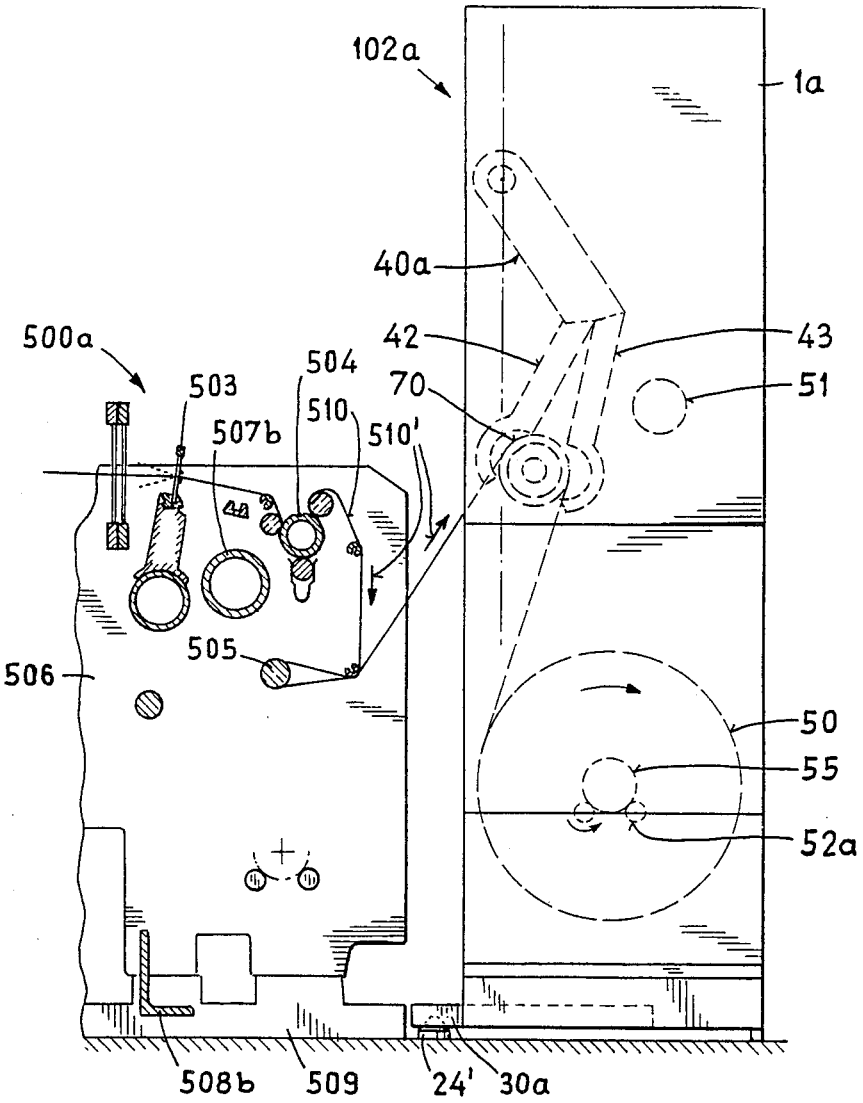
FIG. 5 illustrates a view similar to FIG. 2 with the gripper arms releasing the wind-on beam.
Figure 6:
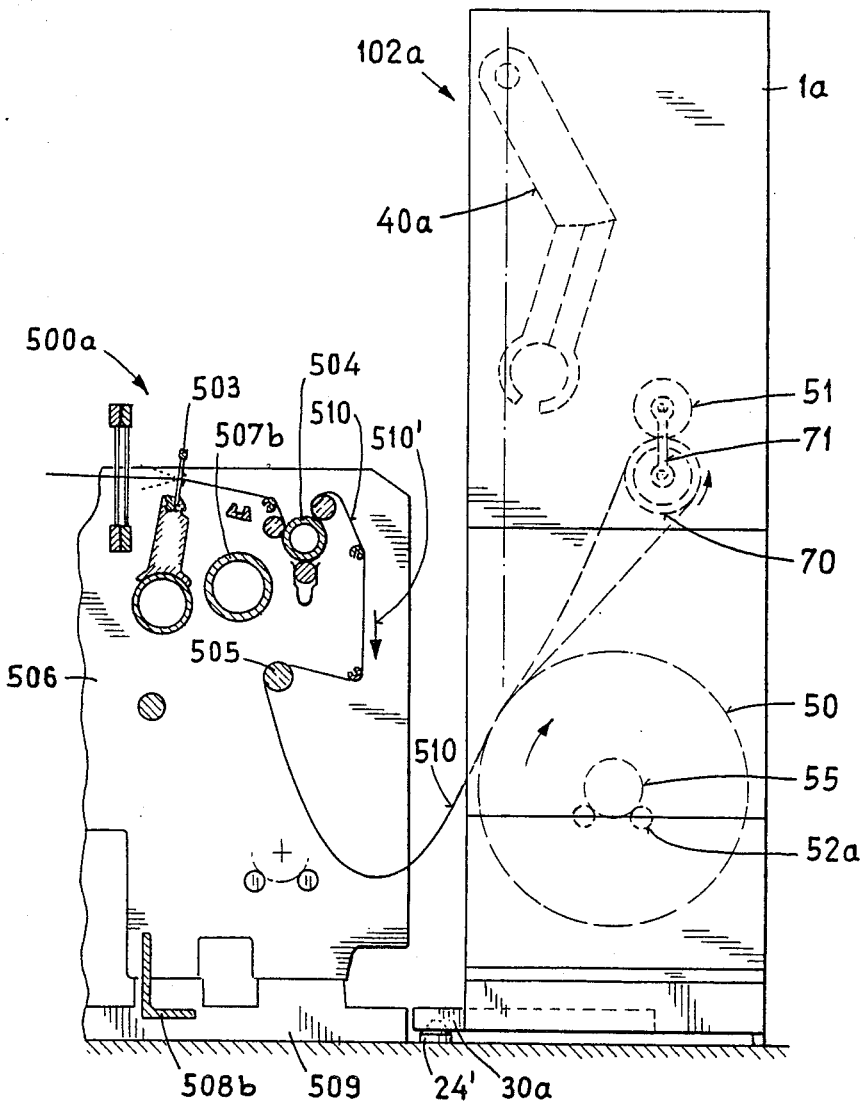
FIG. 6 illustrates similar to FIG. 2 of the wind-on beam in a position to move about a fresh cloth beam.

Referring to FIG. 5, the gripper arms move the wind-on beam 70 to an intermediate position and release the beam 70 thereat. From this position, a manipulator 71 (see FIG. 6) picks up the wind-on beam 70 and moves the beam 70 to the fresh cloth beam 51. During this time, a reserve of cloth is formed by the continued rotation of the wind-on beam 70.

Figure 7:
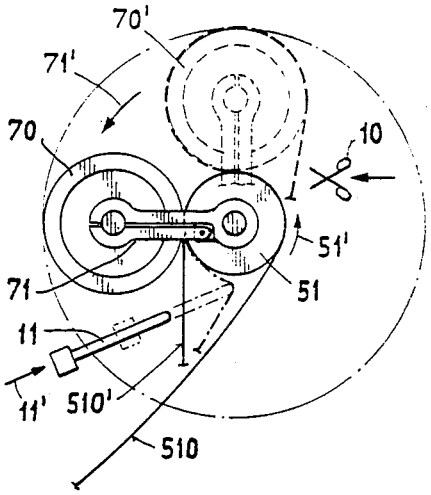
FIG. 7 illustrates a view of the wind-on beam and fresh cloth beam relative to a cutter and a folding blade in accordance with the invention.

Referring to FIG. 7, the wind-on beam 70 is moved by the manipulator 71 about the fresh cloth beam 51 in a counter-clockwise direction while rotating. Under these conditions, the loop of fabric 510 is increased further. After the wind-on beam has reached a position indicated in dotted line in FIG. 7, for example, directly above the fresh cloth beam 51, the cutter 10 is activated in order to cut the fabric between the fresh cloth beam 51 and the full cloth beam 50 (not shown). The wind-on beam continues to move further about the cloth beam 51 into the solid line position illustrated. At this time, the free end 510' of the fabric hangs down freely from the cloth beam 51. The folder 11 is then activated to move into the solid line position indicated to press the free end of the fabric against the cloth beam 51, for example by forming a small fold in the fabric. The cloth beam 51 is then rotated counter-clockwise in the direction indicated by the arrow 51' so as to wind on the fabric. At the same time, the free end of the fabric is pressed tightly against the beam 51 by the overlying windings. At the same time, the portion of the fabric extending towards the weaving machine is stretched taut.

Figure 8:
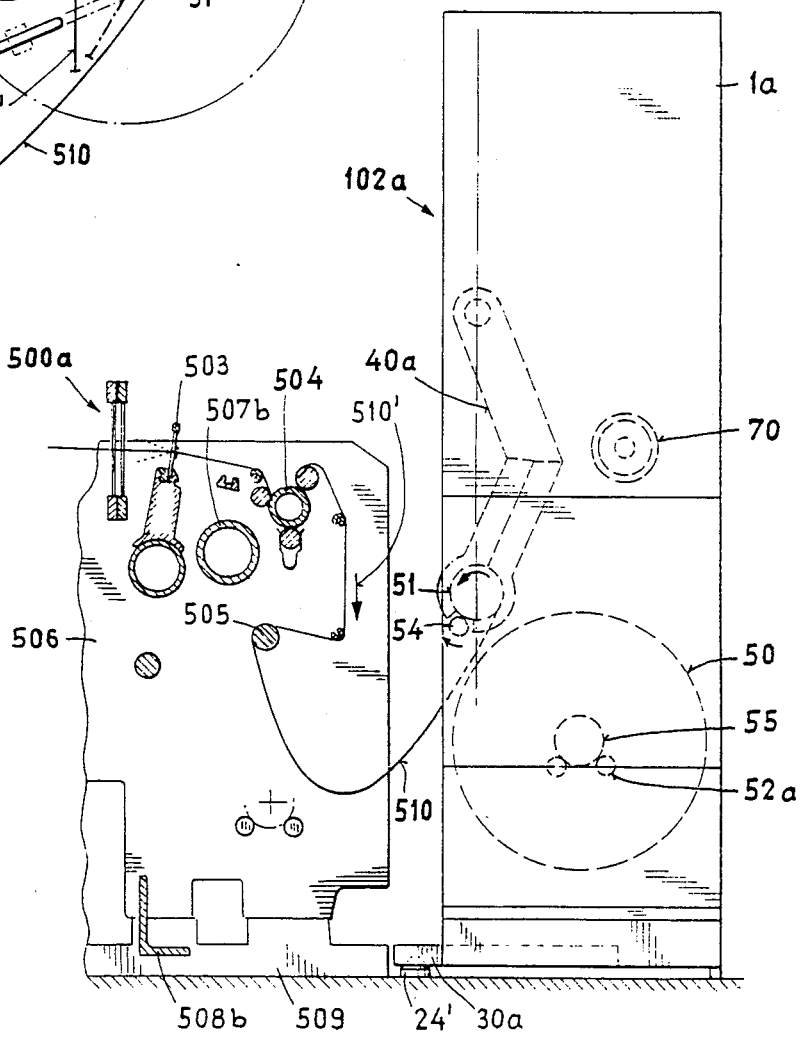
FIG. 8 illustrates a view similar to FIG. 2 of the gripper arms in a position for moving the fresh cloth beam from the transporter.

Referring to FIG. 8, the gripper arms are actuated so as to engage the cloth beam 51 and to move the cloth beam into an intermediate position in which the beam 51 is rotated by means of an auxiliary drive 54 until the fabric portion is taut. The gripper arms then deposit the fresh cloth beam 51 into the weaving machine as indicated in FIG. 9 whereupon a drive inside the weaving machine effects the continued winding of the fabric.

Figure 9:
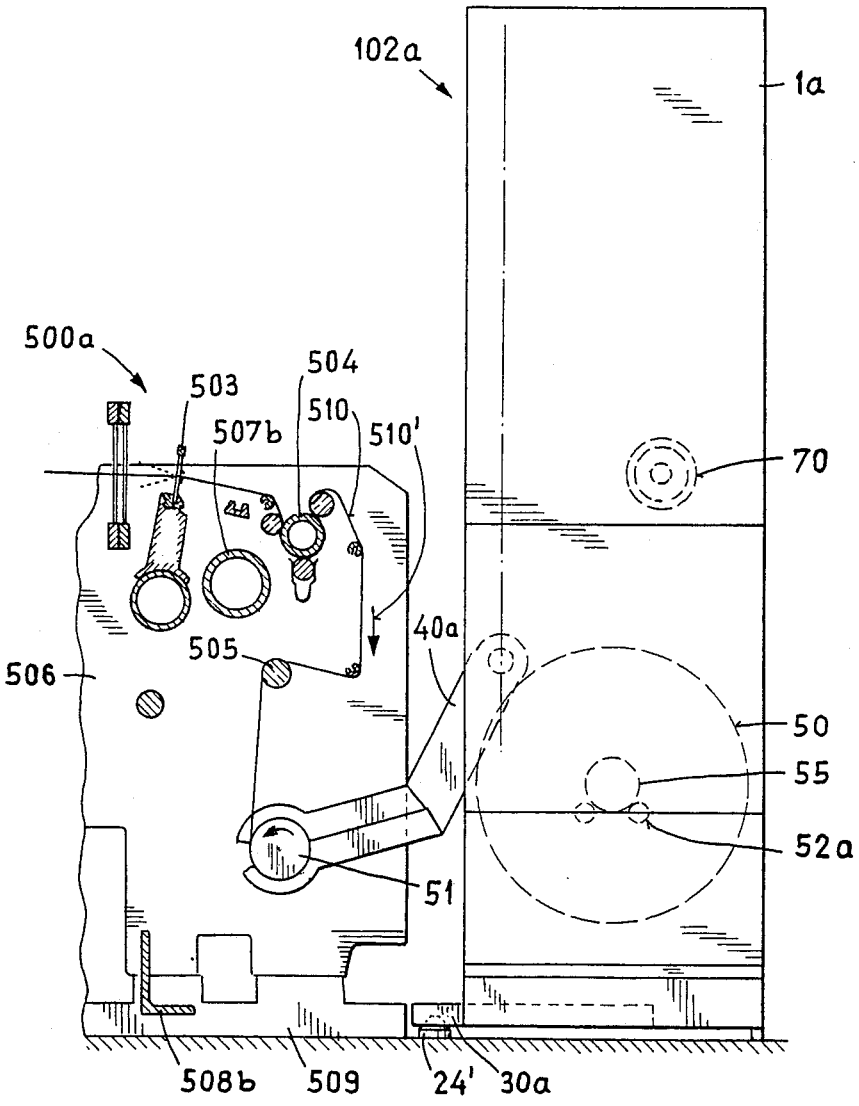
FIG. 9 illustrates a view similar to FIG. 2 of the gripper arms in a position for mounting the fresh cloth beam with the cloth thereon in the weaving machine.
Figure 10:
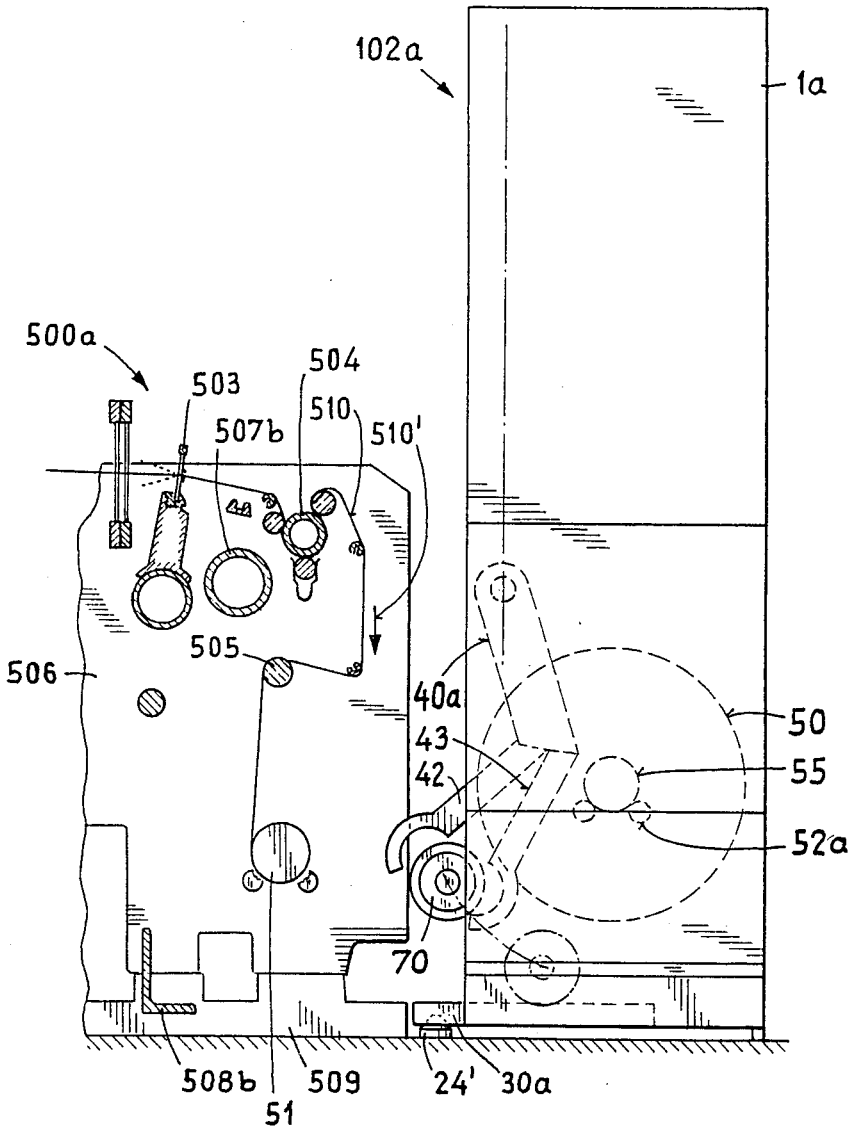
FIG. 10 illustrates a view similar to FIG. 2 of the gripper arms in a position for returning the wind-on beam to the initial position thereof.

Referring to FIG. 10, after the gripper arms have released the fresh cloth beam 51, the arms are moved so as to transfer the wind-on beam from the upper most position shown in FIG. 9 to the position indicated in FIG. 10 for transfer to the manipulator 72 thereat (not shown). The manipulator 72 is then able to move the wind-on beam back to the initial position.

Figure 11:
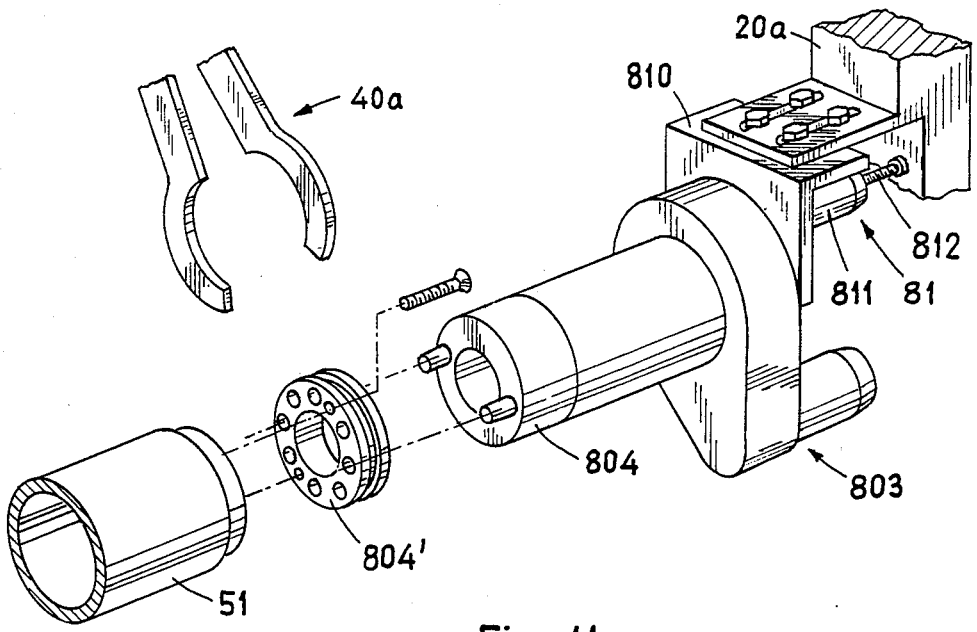
FIG. 11 illustrates an exploded view of an adaptor disc and dog clutch arrangement for driving of a fresh cloth beam.

Referring to FIG. 11, the carrier unit of the transporter is provided with a means for mounting and driving the fresh cloth beam 51 which includes a transmission 81. As indicated, the transmission 81 is mounted on a bracket 810 which is adjustable relative to the side portion 20*a* and includes a motor 811 for actuating a threaded screw 812 by means of which the bracket 810 can be moved relative to the side portion 20*a*. In addition, a propulsion unit 803 depends from the bracket 810 and carries a dog clutch 804 having a pair of outwardly extending pins for engaging in respective bores of an adaptor disc 804'. As indicated, the adaptor disc 804' is mounted by screws on the end of the fresh cloth beam 51. In addition, the disc 804' is provided with a peripheral groove to receive the limbs of a gripper arm 40*a*.

In order to couple the cloth beam 51 in the transporter 102, the gripper arms 40*a*, 40*b* move the beam 51 into alignment with the respective dog clutches 804. In this respect, only the mounting of one side of the cloth beam 51 will be further described since an identical operation is carried out on both sides. For example, after alignment, the motor 811 of the transmission 81 is actuated to move the dog clutch 804 laterally into engagement with the adapted disc 804'. In this way, the propulsion unit 803 can then rotate the beam 51.

Figure 12:
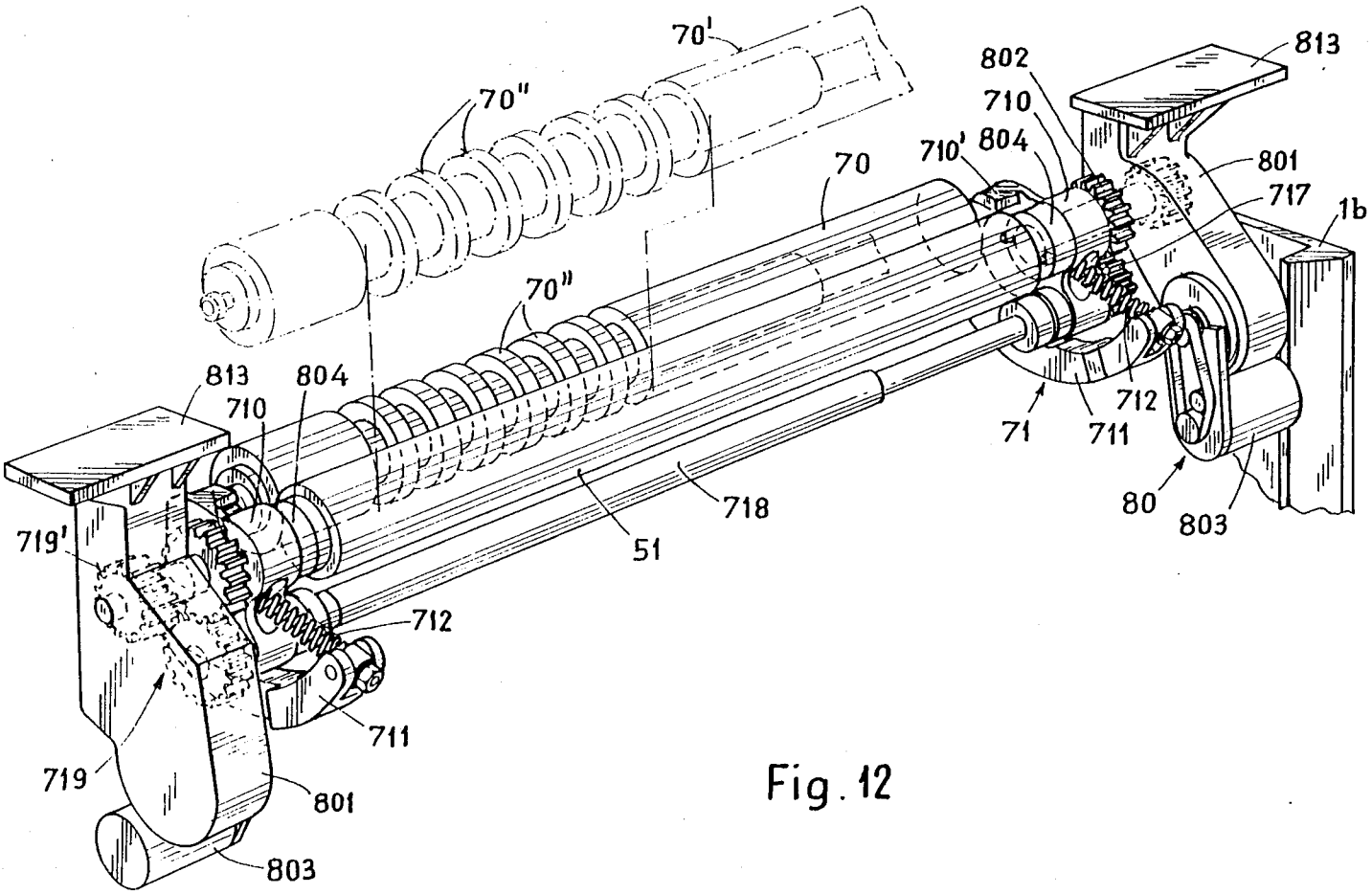
FIG. 12 illustrates a perspective view of a transmission for moving the wind-on beam about a mounted empty cloth beam in accordance with the invention.

Referring to FIG. 12, wherein like reference characters indicate like parts as above, a manipulator 71 is provided on both sides of the carrier unit for moving each wind-on beam 70 about the fresh cloth beam 51. As indicated, the manipulator 71 cooperates with a coupling device 80 which has a housing 801 mounted at the bottom Of a base plate 813. As indicated, the propulsion unit 803 is mounted below the housing 801 and is articulated to the dog clutch 804 for the rotation of the cloth beam 51. A sun wheel 802 is fixedly mounted on the axis of the beam 51 while a housing 710 is mounted between the sun wheel 802 and the clutch 804. As indicated, the housing 710 is constructed to carry a planetary wheel 717 which meshes with the sun wheel 802. The housing 710 is mounted to be freely rotatable on a continuation of the housing 801. The planatary wheel 717 is driven from the other side of the transporter by a shaft 718 by means of a gear wheel drive 719, the drive wheel 719' of which is mounted concentrically of the cloth beam 51.

Rotation of the shaft 718 causes the planetary wheel 717 to roll on the fixed sun wheel 802 so that the housing 710 performs a pivoting movement about the axis of the cloth beam 51.

Referring to FIG. 13*a*, the manipulator 71 includes a lever 711 which is mounted via a pin 716 (see FIG. 13*b*) so as to pivot relative to the housing 710. In addition, the lever carries a spring 712 at one end which is connected to the housing. A recess 715 is provided at the opposite end of the lever 711 in order to receive an end of a wind-on beam. A cover 710' is also provided for engaging the end of the beam when in place.

The manipulator 71 also has a cam roller 713 which is adapted to cooperate with a fixed cam track 714 mounted on the side part 20*b*. In a specific angular range of the housing 710, during rotation, the cam roller 713, comes into contact with the cam track 714 so that the lever 711 moves towards the axis of the cloth beam 51 with the spring 712 being compressed. At the same time, the recessed end of the lever 711 is pivoted outwardly. In this position, the wind-on beam 70 is lifted from below and inserted into the recess 715. As the lever 711 pivots back after insertion of the wind-on beam 70, the projection 710' of the housing moves over the recess 715 so that the inserted journal of the wind-on beam 70 is locked in place.

While FIG. 13*a* shows the position of the manipulator 71 in the take-over position of the wind-on beam 70, FIG. 13*b* shows the position of the manipulator 71 during the movement of the wind-on beam 70 about the fresh cloth beam 51.

Since the length of the transporter 102 is to be adjusted to different weaving widths, the drive shaft 718 of FIG. 12 and the wind-on beam 70 must be longitudinally adjustable. To this end, the shaft 718 and the beams 70 may be made of telescopic rods or tubes. As indicated in FIG. 12, the right-hand part of the wind-on beam 70 forms a telescopic tube while the left-hand part is formed by a telescopic rod and individual segments 70" mounted thereon with the same diameter as the telescopic tube. When the wind-on beam 70 is adjusted for a new weaving width, the distance between the segments 70" is also changed.

The invention thus provides a relatively simple method for exchanging a fresh cloth beam for a full cloth beam in a weaving machine without interrupting the weaving operation of the weaving machine and without having to cut the cloth in the weaving machine.

Further, the invention provides a relatively simple transporter by means of which a fresh cloth beam may be exchanged for a full cloth beam in an automatic manner.

What is claimed is:

1. A method of changing cloth beams in a weaving mill comprising the steps of transferring a full cloth beam from a weaving machine into a predetermined position in a transporter;

moving a wind-on beam into the path of fabric between the weaving machine and full cloth beam to form a loop of fabric;

moving the wind-on beam with the loop of fabric about a fresh cloth beam in the transporter;

cutting the fabric between the fresh cloth beam and full cloth beam;

positioning a free cut end of the fabric against the fresh cloth beam;

rotating the fresh cloth beam to wind the fabric thereon over the free cut end of the fabric; and transferring the fresh cloth beam with the fabric windings thereon to the weaving machine.

2. A transporter for a weaving mill comprising a device for receiving a full cloth beam;

means for rotatably mounting at least one fresh cloth beam on a fixed axis;

a wind-on beam; and gripping arms for moving said wind-on beam between a full cloth beam received in said device and a fresh cloth beam mounted on said means.

3. A transporter as set forth in claim 2 which further includes an adaptor disc mounted at each end of the mounted fresh cloth beam, each said gripper arm being engageable with a respective disc for movement of said fresh cloth beam.

4. A transporter as set forth in claim 3 wherein each disc has a plurality of bores and said means includes a dog clutch for engaging in at least some of said bores of a respective disc for driving and carrying of the fresh cloth beam.

5. A transporter as set forth in claim 2 wherein said gripper arms are movable from a first position engaging said wind-on beam to a second position positioning said beam between said device and said means to form a loop in a fabric extending from a weaving machine to a full cloth beam mounted on said device.

6. A transporter as set forth in claim 5 which further comprises a manipulator for engaging and moving said wind-on beam from said second position to a position adjacent said fresh cloth beam mounted on said means.

7. A transporter as set forth in claim 6 wherein said manipulator is movable about the fresh cloth beam to move said wind-on beam there around and wherein said transporter further comprises a cutter for cutting the fabric to form a free end for transfer to the fresh cloth beam.

8. A transporter as set forth in claim 7 wherein further comprises a folder for pressing said free end against the fresh cloth beam and means for rotating the fresh cloth beam for winding of the cloth thereon.

9. A transporter as set forth in claim 8 wherein said gripper arms are movable to engage and transfer the fresh cloth beam with fabric windings thereon into the weaving machine.

10. A transporter for a weaving mill comprising
first means for mounting a full cloth beam thereon;
second means for mounting a fresh cloth beam in parallel relation to the full cloth beam;
a wind-on beam mounted below said first means;
a pair of movable gripper arms, said arms being movable from a first position engaging said wind-on beam to a second position positioning said wind-on beam between said first means and said second means to form a loop in a fabric extending from a weaving machine to the mounted full cloth beam, said arms being movable to a third position engaging the fresh cloth beam and to a fourth position positioning the fresh cloth beam in the weaving machine; and
a cutter for cutting the loop of fabric between the mounted full cloth beam and the fresh cloth beam to form a free end of fabric for winding onto the fresh cloth beam.

11. The combination as set forth in claim 10 wherein each said gripper arm is movable along a vertical path and is pivotable about a horizontal axis in said path.

12. The combination as set forth in claim 10 which further comprises at least one manipulator for moving said wind-on beam from said second position to a position adjacent the fresh cloth beam.

13. A transporter for a weaving mill comprising
first means for mounting a full cloth beam thereon;
second means for mounting a fresh cloth beam in parallel relation to the full cloth beam;
a wind-on beam mounted below said first means;
a pair of movable gripper arms, said arms being movable to lift a full cloth beam out of a weaving machine for mounting on said first means, said arms being movable from a first position engaging said wind-on beam to a second position positioning said wind-on beam between said first means and said second means to form a loop in a fabric extending from the weaving machine to the mounted full cloth beam, said arms being movable to a third position disengaged from said wind-on beam and engaging the fresh cloth beam and to a fourth position positioning the fresh cloth beam in the weaving machine; and
a cutter for cutting the loop of fabric between the mounted full cloth beam and the fresh cloth beam between said second and third positions to form a free end of fabric for winding onto the fresh cloth beam.

14. The combination as set forth in claim 13 which further comprises at least one manipulator for moving said wind-on beam from said second position to a position adjacent the fresh cloth beam.

* * * * *

UNITED STATES PATENT AND TRADEMARK OFFICE

CERTIFICATE OF CORRECTION

PATENT NO. : 4,892,119

DATED : January 9, 1990

INVENTOR(S) : HUGO SCHILLING, et al

It is certified that error appears in the above-identified patent and that said Letters Patent is hereby corrected as shown below:

Title page:

In the Abstract, line 3 "into" should be -onto-
In the Abstract, line 4 "beams" should be -beam-
Column 2, line 55 "illustrates" should be -illustrates a view-
Column 4, line 30 "carrier" should be -carried-
Column 5, line 39 "the" should be -each-
Column 5, line 41 "Of" should be -of-
Column 7, line 24 "wherein" should be -which- Signed and Sealed this Twenty-fifth Day of June, 1991

*Attest:*

*Attesting Officer*

HARRY F. MANBECK, JR.

*Commissioner of Patents and Trademarks*